US007317889B2

(12) United States Patent
Suzuki

(10) Patent No.: US 7,317,889 B2
(45) Date of Patent: Jan. 8, 2008

(54) IMAGE FORMING APPARATUS WHEREIN A SPEED OF A DEVELOPED CARRYING MEMBER IS CONTROLLED RELATIVE TO A SPEED OF AN IMAGE BEARING MEMBER

(75) Inventor: Hideaki Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 11/290,501

(22) Filed: Dec. 1, 2005

(65) Prior Publication Data

US 2006/0127133 A1 Jun. 15, 2006

(30) Foreign Application Priority Data

Dec. 14, 2004 (JP) ..... 2004-362070

(51) Int. Cl.
*G03G 15/00* (2006.01)
*G03G 15/08* (2006.01)

(52) U.S. Cl. ..... 399/236; 399/44; 399/45; 399/53; 399/167

(58) Field of Classification Search ..... 399/44, 399/45, 53, 167, 236, 254, 256
See application file for complete search history.

(56) References Cited

U.S. PATENT DOCUMENTS 5,148,218 A * 9/1992 Nakane et al. ..... 399/44 X
5,628,043 A * 5/1997 Ikeda et al. ..... 399/236 X
6,301,452 B1 * 10/2001 Yoshizawa ..... 399/45
6,539,183 B2 * 3/2003 Ishimizu et al. ..... 399/45

FOREIGN PATENT DOCUMENTS

JP 62-98373 5/1987
JP 4-324469 11/1992

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes a rotatable image bearing member bearing an electrostatic image; a rotatable developer carrying member carrying a developer to develop the electrostatic image; speed controlling means for switching a rotating speed of the image bearing member between a first speed and a second speed lower than the first speed, and performing an image forming operation at each speed; and developer carrying member speed controlling means for controlling a rotating speed of the developer carrying member so that a rotating speed of the developer carrying member when the image forming operation is performed by rotating the image bearing member at the second speed, which is less than 70% of the first speed so as to be within a range of ±30% of a rotating speed of the developer carrying member when the image forming operation is performed by rotating the image bearing member at the first speed.

4 Claims, 9 Drawing Sheets

| | AT PLAIN PAPER MODE | AT OHT, THICK PAPER MODE |
|---|---|---|
| PHOTOSENSITIVE DRUM PERIPHERAL SPEED [mm/sec.] | 160 | 80 |
| DEVELOPING SLEEVE PERIPHERAL SPEED [mm/sec.] | 240 | 168 TO 312 |
| PERIPHERAL SPEED RATIO (=DEVELOPING SLEEVE PERIPHERAL SPEED/ PHOTOSENSITIVE DRUM PERIPHERAL SPEED) | 1.5 | 2.1 TO 3.9 |

| NUMBER OF SHEETS | AT PLAIN PAPER MODE | AT OHT, THICK PAPER MODE |
|---|---|---|
| 0 TO 20000 SHEETS | 1.5 | 1.5 |
| 20000 TO 40000 SHEETS | 1.5 | 3.0 |
| FROM 40000 SHEETS | 1.5 | 3.5 |

FIG. 11

| | AT PLAIN PAPER MODE | AT OHT, THICK PAPER MODE |
|---|---|---|
| PHOTOSENSITIVE DRUM PERIPHERAL SPEED Vd [mm/sec.] | 180 | 80 |
| DEVELOPING SLEEVE PERIPHERAL SPEED Vs [mm/sec.] | 240 | 240 |
| PERIPHERAL SPEED RATIO [Vs/Vd] | 1.5 | 3.0 |
| AGITATING MEANS PERIPHERAL SPEED Va [mm/sec.] | 408 | 204 |
| PERIPHERAL SPEED RATIO [Va/Vs] | 1.7 | 0.85 |

FIG. 12
PRIOR ART

| | AT NORMAL MODE | AT OHT MODE |
|---|---|---|
| PHOTOSENSITIVE DRUM PERIPHERAL SPEED Vd [mm/sec.] | 150 | 75 |
| DEVELOPING SLEEVE PERIPHERAL SPEED Vs [mm/sec.] | 228 | 114 |
| PERIPHERAL SPEED RATIO (=DEVELOPING SLEEVE PERIPHERAL SPEED/ PHOTOSENSITIVE DRUM PERIPHERAL SPEED) | 1.52 | 1.52 |

IMAGE FORMING APPARATUS WHEREIN A SPEED OF A DEVELOPED CARRYING MEMBER IS CONTROLLED RELATIVE TO A SPEED OF AN IMAGE BEARING MEMBER

BACKGROUND OF THE INVENTION

1. Field of the Invention

The invention relates to an image forming apparatus such as a printer, a copying machine or a facsimile apparatus of an electrophotographic printing method.

2. Related Background Art

An image forming apparatus such as a printer, a copying machine or a facsimile apparatus using an electrophotographic printing method is generally provided with a photosensitive drum as an image bearing member. Around the photosensitive drum, substantially in succession along the rotation direction thereof, there are disposed a charging device for uniformly charging the surface of the photosensitive drum to a predetermined polarity and predetermined potential, an exposing device for exposing the surface of the photosensitive drum after being charged to thereby form an electrostatic latent image, a developing apparatus for developing the electrostatic latent image as a toner image, a transferring device for transferring the toner image onto a transfer material (transfer medium) such as paper, and a fixing device for fixing the toner image on the transfer material and making it into a permanent image.

As the developing methods of the above-mentioned developing apparatus, there are a dual-component developing method using, for example, a developer comprising carrier particles (carrier) which are a magnetic material and toner particles (toner) which are a nonmagnetic material mixed together at a predetermined ratio, and a monocomponent developing method using a developer constituted by only a magnetic or nonmagnetic toner.

For example, in the dual-component developing method, a magnetic brush is formed on the surface of a developing sleeve having disposed therein a magnet roller which is magnetic field generating means. The developing sleeve is opposed to the photosensitive drum with a minute gap therebetween to thereby form a developing nip portion. The magnetic brush borne on the surface of the developing sleeve is brought into contact with or proximity to the photosensitive drum and further, an alternating electric field is continuously applied to the developing nip portion to thereby shift the toner on the surface of the developing sleeve onto the photosensitive drum.

At that time, as shown in FIG. 12 of the accompanying drawings it is ordinary to make a photosensitive drum peripheral speed (process speed) higher than a developing sleeve peripheral speed to thereby give a predetermined peripheral speed difference. In FIG. 12, when the photosensitive drum peripheral speed is 150 mm/sec., the developing sleeve peripheral speed is 228 mm/sec., whereby the peripheral speed ratio is 1:1.52. The developing sleeve peripheral speed is thus increased relative to the photosensitive drum peripheral speed to thereby give a peripheral speed difference, whereby the toner amount supplied per unit area on the photosensitive drum can be increased and therefore, it becomes possible to sufficiently charge the electrostatic latent image with the toner, and it becomes possible to stably obtain sufficient image density.

Now, many of image forming apparatuses using the electrophotographic printing method are designed to be capable of selecting an image forming mode in which the processing speed by the fixing device is changed so that images of different image qualities can be obtained depending on the kinds of the transfer materials used or the kinds of images a user desires to obtain. For example, there is an image forming apparatus provided with two or more kinds of image forming modes such as an OHT mode for forming an image of high transparency on transparent film for an overhead projector (hereinafter referred to as the "OHT"), a thick paper mode for forming an image on thick paper inferior in fixing, and a gloss mode for forming an image rich in gloss to emphasize the brightness of colors, besides a normal image forming mode.

In the above-described OHT mode and the gloss mode, design is made such that the fixing process speed is reduced and the time required for the transfer material to pass through the fixing device is lengthened to thereby increase the heating time, thereby enhancing the fusibility of the toner, and enhancing the transparency and glossiness.

When the processing speed in the fixing device is reduced as described above, it is also necessary to reduce the conveying speed of the transfer material and therefore, depending on the type of the image forming apparatus, it is also necessary to reduce the peripheral speed of the photosensitive drum in accordance therewith.

In that case, it has heretofore been usual to reduce also the peripheral speed of the developing sleeve in accordance with the reduction in the peripheral speed of the photosensitive drum, and make the peripheral speed ratio between the two the same as that at the normal image forming mode. This is because heretofore, a construction in which the driving of the photosensitive drum and the developing sleeve is effected by a single drive source has been ordinary.

For example, in the above-described example, as shown in FIG. 12, in the normal mode, the photosensitive drum peripheral speed is 150 mm/sec., the developing sleeve peripheral speed is 228 mm/sec. and the peripheral speed ratio therebetween is 1:1.52, where as at the OHT mode, the photosensitive drum peripheral speed and the peripheral speed of the rotation of the developing sleeve are both reduced by a half, to 75 mm/sec. and 114 mm/sec. to thereby make the peripheral speed ratio the same as that at the normal mode, namely, 1.52.

In Japanese Patent Application Laid-open No. S62-98373 and Japanese Patent Application Laid-open No. H4-324469, there is described an apparatus in which the peripheral speed ratio between the photosensitive drum and the developing sleeve is variably controlled.

However, when at an image forming mode in which the peripheral speed of the photosensitive drum is thus made lower than that at the normal image forming mode, the peripheral speed of the developing sleeve is also made low at the same rate without the peripheral speed ratio being changed, the following problems have arisen.

The toner supplied into the developing apparatus rubs against the carrier in the case of the dual-component developing method, or against the developing sleeve or a layer thickness regulating member in the case of the monocomponent developing method, to thereby be given a desired charging amount, and thereafter is used for development. At that time, of course, it is desirable that as the toner, the distribution of the charging amount thereof be sharp and the proportion of the toner having an appropriate charging amount be high.

The charging amount of the toner, however, actually assumes a broad distribution having a certain degree of expanse as shown in FIG. 13 of the accompanying drawings, depending on the state of the carrier or the developing sleeve on the side giving charges, or the state of a charge control agent for the toner or an extraneous additive assisting the charging. The toner used here is a negative toner charged to the minus polarity, and the (−) side of the axis of abscissas of FIG. 13 indicates the distribution of a toner charged to a regular polarity, and the (+) side of the same axis indicates the distribution of a toner charged to the opposite polarity.

In the distribution shown in FIG. 13, the toner having a charging amount in the vicinity of 0 (zero) which is indicated by an area "A", and a toner (reversed toner) charged to the opposite polarity cause the phenomenon of so-called "fog" that they cannot be completely controlled by a developing bias, but adhere to the white background portion of the transfer material.

It has become apparent by the inventors' studies that if in the distribution of the toner charging amount, in a state in which the distribution of the toner having a charging amount in the vicinity of 0 (zero) or the toner charged to the opposite polarity is large, i.e., a situation in which the fog is liable to occur, at an image forming mode whereat the peripheral speed of the photosensitive drum is made low as at the OHT mode and the thick paper mode, the peripheral speed of the developing sleeve is also made low at the same ratio as the speed reduction ratio of the photosensitive drum, the fog is more aggravated. This can be explained as follows.

The toner amount T supplied per unit area of the developing portion (developing nip) during development is proportional to the peripheral speed ratio Vr between the photosensitive drum and the developing sleeve, and the bearing amount M of the developer on the developing sleeve per unit area.

$$T \propto Vr \times M \quad (1)$$

In the case of a dual-component developer, the toner amount T is the value of expression (1) multiplied by toner density (TD) and thus, $$T \propto Vr \times M \times TD \quad (2)$$

A part of this toner amount supplied to the developing nip portion flies to the photosensitive drum by the action of a developing bias, whereby development is effected.

In the distribution of the toner charging amount shown in FIG. 13, the toner having a normal charging amount (the toner in an area other than the area "A") is liable to follow the developing bias applied to the developing nip portion and therefore, the time required for light portion potential (in the case of reversal development) to be fully charged is sufficiently shorter than a developable time (the time required for the photosensitive drum to pass the developing nip portion), and even if the peripheral speed of the photosensitive drum is made low to thereby lengthen the developable time the developing amount per unit area is hardly charged. That state is indicated by solid line "$a_{14}$" in FIG. 14 of the accompanying drawings.

Also, in the case of the toner having a normal charging amount, when the toner has entered the developing nip portion, the time required until such toner receives the action of the developing bias therein and the probability of the toner with which it becomes capable of flying to the photosensitive drum is also sufficiently shorter than the toner staying time on the developing sleeve when viewed from the photosensitive drum. Therefore, even if the peripheral speed of the developing sleeve is made low to thereby lengthen the toner staying time, the developing amount is hardly changed. That state is indicated by solid line "$a_{15}$" in FIG. 15 of the accompanying drawings. However, when the peripheral speed ratio Vr is too small, even the toner having a normal charging amount does not sufficiently rise in charging rate and therefore, depending on the construction of the developing apparatus used, the developing bias, the kind of the developer, etc., it is necessary to provide an appropriate peripheral speed ratio. In the examples shown in FIGS. 14 and 15, Vr is set to 1.5.

In contrast, the toner having a low charging amount indicated by the area "A" in FIG. 13 is bad in its follow-up property to the developing bias and therefore, even when it is supplied to the developing nip portion, it does not immediately move to the dark portion potential (in the case of reversal development) of the photosensitive drum. In such a case, the developing amount (fog amount) comes to depend on the developable time and the toner staying time on the developing sleeve when viewed from the photosensitive drum, and comes to increase in proportion to these times. That is, the lower the peripheral speeds of the photosensitive drum and the developing sleeve become, the more the developing amount (fog amount) increases. Those states are indicated by dotted lines "$b_{14}$" and "$b_{15}$" in FIGS. 14 and 15, respectively.

Thus, fog becomes more aggravated when at an image forming mode such as the OHT mode whereat the peripheral speed of the photosensitive drum is made low, the peripheral speed of the developing sleeve is also made low so as to keep the peripheral speed ratio constant.

SUMMARY OF THE INVENTION

So, the present invention has as its object to suppress the fog when in an image forming apparatus which can effect image formation at two kinds of rotating speeds of an image bearing member, the rotating speed of the image bearing member is made An image forming apparatus for achieving the above object has:

an image bearing member rotatable with an electrostatic image borne thereon;

a developer carrying member rotated with a developer carried thereon and conveying the developer to a developing portion to thereby effect the development of the electrostatic image;

image bearing member speed controlling means for switching the rotating speed of the image bearing member between a first speed and a second speed lower than the first speed, and performing an image forming operation at each speed; and developer carrying member speed controlling means for controlling the rotating speed of the developer carrying member so that the rotating speed of the developer carrying member when the image forming operation is performed at the second speed controlled so as to be less than 70% of the first speed may be within a range of ±30% of the rotating speed of the developer carrying member when the image forming operation is performed at the first speed.

BRIEF DESCRIPTION OF THE DRAWINGS

FIG. 11 illustrates the photosensitive drum peripheral speeds, the developing sleeve peripheral speeds, the peripheral speed ratios, the agitating means peripheral speed and the peripheral speed ratios at the plain paper mode and at the OHT, thick paper mode in Embodiment 3.

FIG. 12 illustrates photosensitive drum peripheral speeds, developing sleeve peripheral speeds and peripheral speed ratios at a conventional plain paper mode and at a conventional OHT mode.

DESCRIPTION OF THE PREFERRED EMBODIMENTS

Figure 1:
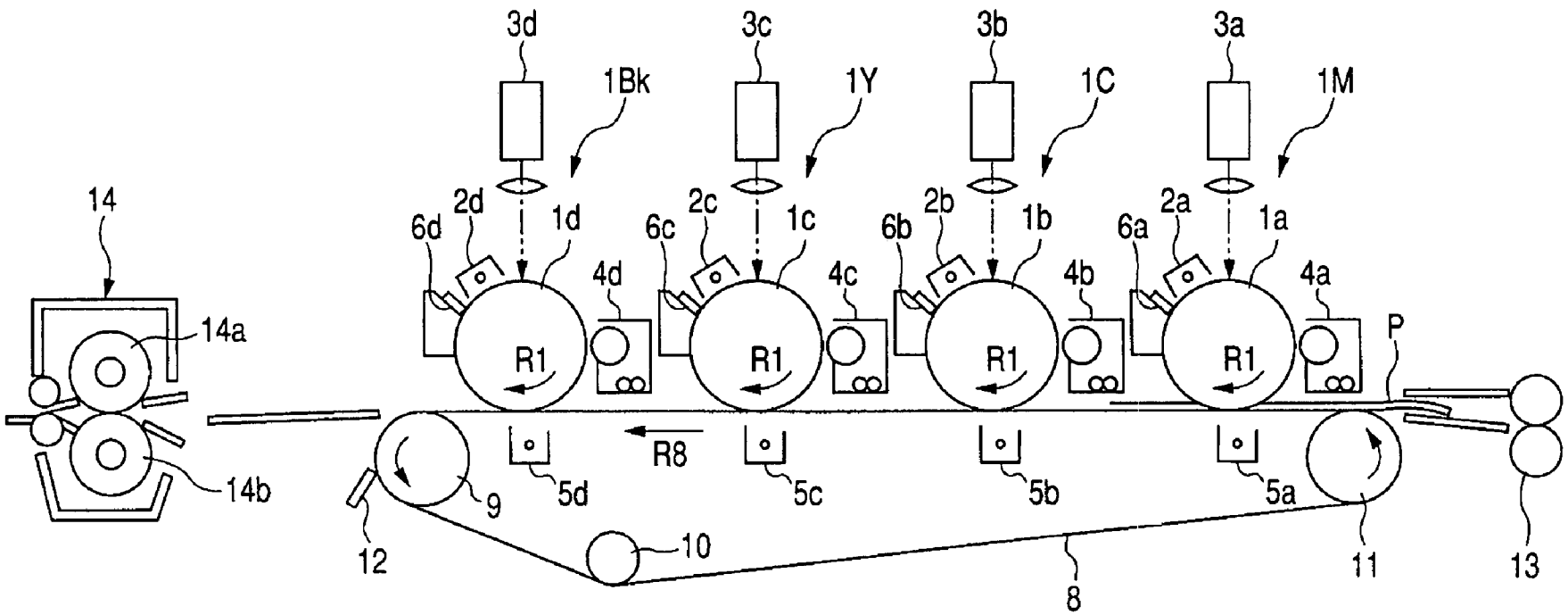
FIG. 1 is a longitudinal cross-sectional view schematically showing the construction of an image forming apparatus according to Embodiments 1 to 3.

Some embodiments of the present invention will hereinafter be described with reference to the drawings. Throughout the drawings, like reference characters designate members and portions similar in construction or action to one another, and a duplicate description of these members and portions will be suitably omitted.

Embodiment 1

FIG. 1 shows an image forming apparatus to which the present invention can be applied. The image forming apparatus shown in FIG. 1 is a four color full-color printer having four image forming portions of an electrophotographic printing method, and FIG. 1 is a longitudinal cross-sectional view schematically showing the construction thereof.

The printer (hereinafter referred to as the "image forming apparatus") shown in FIG. 1 has four image forming portions disposed along the movement direction (the direction indicated by the arrow R8) of a transfer belt 8, i.e., image forming portions 1M, 1C, 1Y and 1Bk for forming magenta (M), cyan (C), yellow (Y) and black (Bk) toner images, respectively, in succession from an upstream side.

Drum-shaped electrophotographic photosensitive members (hereinafter referred to as the photosensitive drums) 1*a*, 1*b*, 1*c* and 1*d* as image bearing members are disposed in the respective image forming portions 1M, 1C, 1Y and 1Bk for rotation in the direction indicated by the arrow R1.

Around the respective photosensitive drums 1*a* 1*b*, 1*c* and 1*d*, there are disposed substantially in succession along the rotation direction thereof primary chargers 2*a*, 2*b*, 2*c*, 2*d*, exposing devices 3*a*, 3*b*, 3*c*, 3*d*, developing apparatuses 4*a*, 4*b*, 4*c*, 4*d*, transfer chargers 5*a*, 5*b*, 5*c*, 5*d*, and cleaning devices 6*a*, 6*b*, 6*c*, 6*d*. Below the photosensitive drums 1*a*, 1*b*, 1*c* and 1*d*, there is disposed a transfer belt 8 stretched around a drive roller 9, a tension roller 10 and a driven roller 11. The transfer belt 8 is adapted to be rotatively driven in the direction indicated by the arrow (counter-clockwise direction as viewed in FIG. 1) of the drive roller 9, and thereby be rotated in the direction indicated by the arrow R8. Registration rollers 13 are disposed upstream of the driven roller 11 with respect to the movement direction of a transfer material P. The registration rollers 13 are adapted to once stop the transfer material P conveyed from the upstream side by a feeding and conveying device (not shown), and supply it to the transfer belt 8 at predetermined timing. A belt cleaner 12 is disposed at a location on the surface of the transfer belt 8 which corresponds to the drive roller 9. A fixing device 14 having a fixing roller 14*a* and a pressure roller 14*b* is disposed downstream of the drive roller 9 with respect to the movement direction of the transfer material P.

When an image forming operation is started in the image forming apparatus of the above-described construction, the surfaces of the photosensitive drums 1*a*, 1*b*, 1*c* and 1*d* are first uniformly charged to a predetermined polarity and predetermined potential by the primary chargers 2*a*, 2*b*, 2*c* and 2*d*, respectively. The surfaces of the photosensitive drums 1*a*, 1*b*, 1*c* and 1*d* after charged have laser beams corresponding to an image signal applied thereto from the exposing devices 3*a*, 3*b*, 3*c* and 3*d*, and the charges of the irradiated portions are removed and electrostatic latent images are formed thereon.

The electrostatic latent images are developed as toner images with toners contained in the developing apparatuses 4*a*, 4*b*, 4*c* and 4*d*. In the present embodiment, use is made of a reversal developing method of causing the toners to adhere to light portions exposed to the laser beams.

Then, the transfer material P contained in a sheet supplying cassette (not shown) is supplied to the transfer belt 8 through a sheet feeding roller (not shown) and the registration rollers 13 in timed relationship with the toner images on the photosensitive drums 1*a*, 1*b*, 1*c* and 1*d*. The supplied transfer material P is electrostatically attracted to the surface of the transfer belt 8. The electrostatically attracted transfer material P is first conveyed to the transferring portion between the photosensitive drum 1*a* of the magenta image forming portion 1M and the transfer charger 5*a*, and the magenta toner image is transferred thereto by the transfer charger 5*a* to which a transferring bias has been applied from a transferring voltage source (not shown). The transfer material P is conveyed to the cyan image forming portion 1C, the yellow image forming portion 1Y and the black image forming portion 1Bk in succession with the rotation of the transfer belt 8, and the toner images of the respective colors are transferred thereto in a similar manner. Thereby, the toner images of the four colors are superposed on the transfer material P. Any toners residual on the surfaces of the photosensitive drums 1*a*, 1*b*, 1*c* and 1*d* after the transfer of the toner images (untransferred toners) are removed by the cleaning devices 6*a*, 6*b*, 6*c* and 6*d*.

Further, the transfer material P is separated from the transfer belt 8, and is conveyed to the fixing device 14, where it is heated and pressurized by the fixing roller 14*a* and the pressure roller 14*b*, whereby the toner images are fixed on the surface of the transfer material P. Thereby, a four-color full-color image is formed on the surface (one side) of a sheet of transfer material P. The toners adhering to the surface of the transfer belt 8 after the separation of the transfer material P are removed by the belt cleaner 12.

The above-described developing apparatuses 4*a*, 4*b*, 4*c* and 4*d* will now be described in greater detail with reference to FIG. 2. The plurality of developing apparatuses 4*a*, 4*b*, 4*c* and 4*d* are all similar in construction to one another and therefore, only the magenta developing apparatus 4*a* will be described herein.

Figure 2:
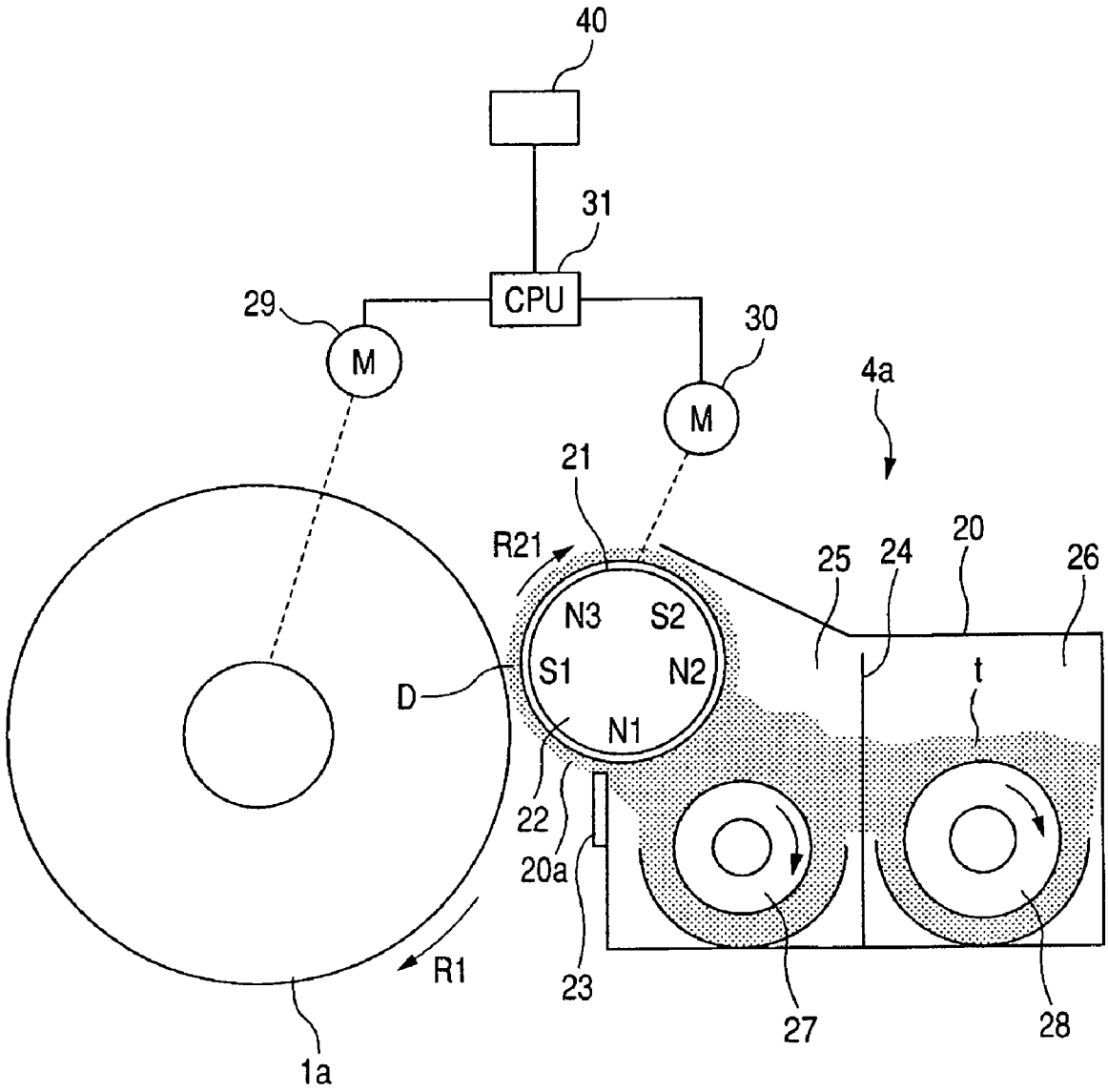
FIG. 2 is an enlarged longitudinal cross-sectional view typically showing the construction of a developing apparatus in Embodiments 1 and 2.

The developing apparatus 4*a* used in the present embodiment adopts a dual-component developing method, and has a developer container 20, as shown in FIG. 2. The interior of the developer container 20 is partitioned into a developing chamber 25 and an agitating chamber 26 by a partition wall 24, and contains therein a dual-component developer "t" consisting of carrier particles (carrier) which are a magnetic material and toner particles (toner) which are a nonmagnetic material. An amount of toner corresponding to the amount of toner consumed by development is supplied from a supplying device (not shown) above to the agitating chamber 26 so that toner density may always be within a predetermined range.

An opening portion 20*a* is formed in that region of the developer container 20 which is opposed to the photosensitive drum 1*a*. In this opening portion 20*a*, there is disposed a rotatable developing sleeve 21 containing a stationary magnet roller 22 therein. Also, near the developing sleeve 21, there is disposed a regulating blade 23 for regulating the developer "t" carried on the surface of the developing sleeve 21 to a predetermined layer thickness.

A conveying screw 27 is disposed in the developing chamber 25, and a conveying screw 28 is disposed in the agitating chamber 26. These conveying screws 27 and 28 are rotated in the directions indicated by the arrows to thereby convey the developer "t" in a direction opposite to the longitudinal direction thereof. Also, the developing chamber 25 and the agitating chamber 26 communicate with each other at the longitudinally opposite end portions thereof. Thus, the developer "t" is adapted to circulate in the developer container 20.

The toner supplied from above to the agitating chamber 26 is frictionally charged with the carrier in the agitating chamber 26 by the rotating operation of the conveying screw 28 to thereby be given a predetermined charging amount. The toner given the charging amount is delivered to the conveying screw 27 together with the carrier, and is further delivered onto the developing sleeve 21.

Figures 3, 4:
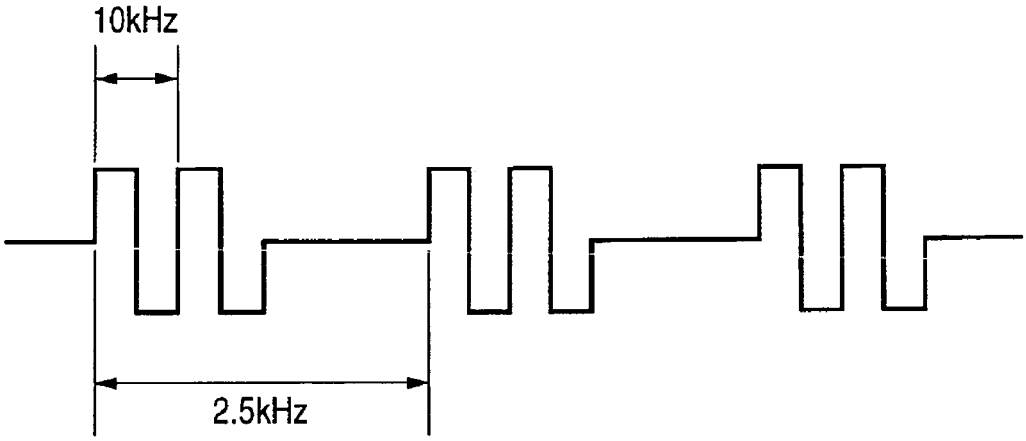
FIG. 3 illustrates the AC waveform of a developing bias.
FIG. 4 illustrates photosensitive drum peripheral speeds, developing sleeve peripheral speeds and peripheral speed ratios at a plain paper mode and at an OHT, thick paper mode in Embodiment 1.

The toner conveyed to the opposed portion (developing nip portion D) between the photosensitive drum 1*a* and the developing sleeve 21 together with the carrier by the rotating operation of the developing sleeve 21, in the direction shown by arrow R21 flies onto the photosensitive drum 1*a* by a developing bias applied to the developing sleeve 21. In the present embodiment, the developing bias comprises an AC component superimposed upon a DC component. Here, in contrast with the dark portion potential VD=−500 V and the light portion potential VL=−150 V of the photosensitive drum 1*a*, the DC potential of the developing bias is set to −370 V. Thereby, a developing contrast Vcont is set to 220 V, and a white background portion contrast Vback is set to 130 V. Also, as the AC component of the developing bias, use is made of a blank pulse bias comprising a combination of a rectangular pulse of 10 kHz and an idle period. The waveform of this developing bias is shown in FIG. 3.

A description will now be made of image forming modes in the image forming apparatus according to the present embodiment.

The image forming apparatus according to the present embodiment has, depending on the kind of the transfer material P used, an OHT mode for effecting image formation on OHT, and a thick paper mode for effecting image formation on thick paper having a thickness of 200 g/m$^2$ or greater, in addition to a plain paper mode for effecting image formation on plain paper.

In the image forming apparatus according to the present embodiment, a design is made such that as shown in FIG. 2, a photosensitive drum motor 29 for driving the photosensitive drum 1*a* and a developing motor 30 for driving the developing sleeve 21 of the developing apparatus 4*a* can be independently controlled as to their rotational driving on the basis of a control signal from a control device (CPU) 31.

As shown in FIG. 4, at the plain paper mode, the photosensitive drum peripheral speed is controlled to 160 mm/sec., and the developing sleeve peripheral speed is controlled to 240 mm/sec., and the peripheral speed ratio between the photosensitive drum peripheral speed and the developing sleeve peripheral speed is set to 240/160=1.5.

In contrast, at both of the OHT mode and the thick paper mode (hereinafter suitably referred to as "the OHT mode, etc."), the photosensitive drum peripheral speed is reduced by half to 80 mm/sec., that is, the speed reduction rate is set to 0.5 to thereby make the fixing process speed low. On the other hand, the developing sleeve peripheral speed is controlled within a range of 168 mm/sec. or greater and 312 mm/sec. or less which is .±−.30% of that at the plain paper mode, and the peripheral speed ratio between the photosensitive drum peripheral speed and the developing sleeve peripheral speed is set to 2.1 or greater and 3.9 or less, and is increased more than at the plain paper mode to thereby suppress the fog of the white background portion. The reason why the peripheral speed of the developing sleeve is set to this range will be described later.

It has been confirmed that in the developing method adopted in the present embodiment, the electrostatic latent image on the photosensitive drum can be fully charged by the peripheral speed ratio Vr between the photosensitive drum 1*a* and the developing sleeve 21 being set to 1.5. As a method of confirming the charging rate, the surface potential of the photosensitive drum 1*a* after the electrostatic latent image has been developed with the toner was found by being measured from on the toner. For the measurement, use was made of a surface potential meter MODEL 344 produced by Trek Co., Inc. and a measuring probe for exclusive use. By this measurement, the potential after a predetermined electrostatic latent image was developed sufficiently converged to −370 V which is the DC level of the developing bias and therefore, the charging rate was judged to be nearly 100%. Therefore, even if as described above, at the OHT mode, etc., the peripheral speed ratio Vr of the developing sleeve 21 to the photosensitive drum 1*a* is made greater than at the plain paper mode, the developing amount of the light portion potential does not increase any more because the charging rate is nearly 100%. Accordingly, image density is not changed greatly.

Heretofore, when at the OHT mode, etc., the peripheral speed of the photosensitive drum 1*a* was reduced by half to 80 mm/sec., the peripheral speed of the developing sleeve 21 was likewise reduced by half to 120 mm/sec. to thereby control the peripheral speed ratio therebetween so as to be kept at 1.5.

Figure 5:
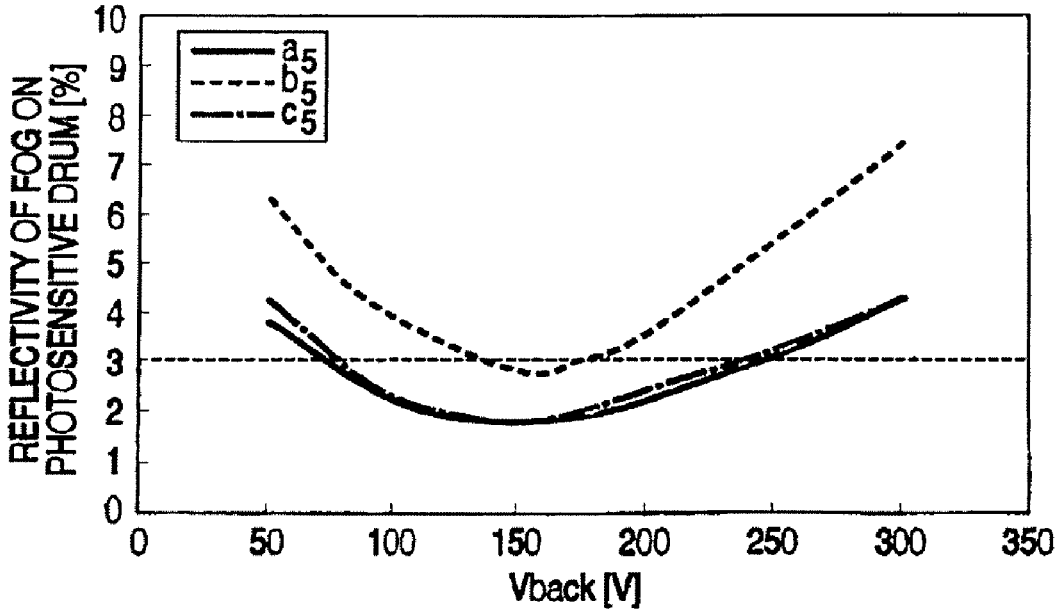
FIG. 5 shows the reflectivity of fog on the photosensitive drum to Vback.

FIG. 5 shows the state of the reflectivity of the fog on the photosensitive drum when such control was effected. In FIG. 5, solid line "$a_5$" refers to the case of the peripheral speed ratio 1.5 at the plain paper mode, and dotted line "$b_5$" refers to also the case of the peripheral speed ratio 1.5 at the OHT mode, etc. It is desirable that the reflectivity of the fog on the photosensitive drum be suppressed to 3% or less, and if it exceeds 3%, there will arise the problem that what is transferred onto the transfer material such as paper or OHT increases to thereby deteriorate the quality of image, or the amount of toner collected by the cleaning device increases to thereby increase the load of the cleaning device. In the case of the dotted line "$b_5$" in FIG. 5, the Vback area in which the reflectivity of the fog becomes 3% or less becomes very narrow and as the result, it becomes difficult to suppress the reflectivity of the fog always to 3% or less.

Figure 14:
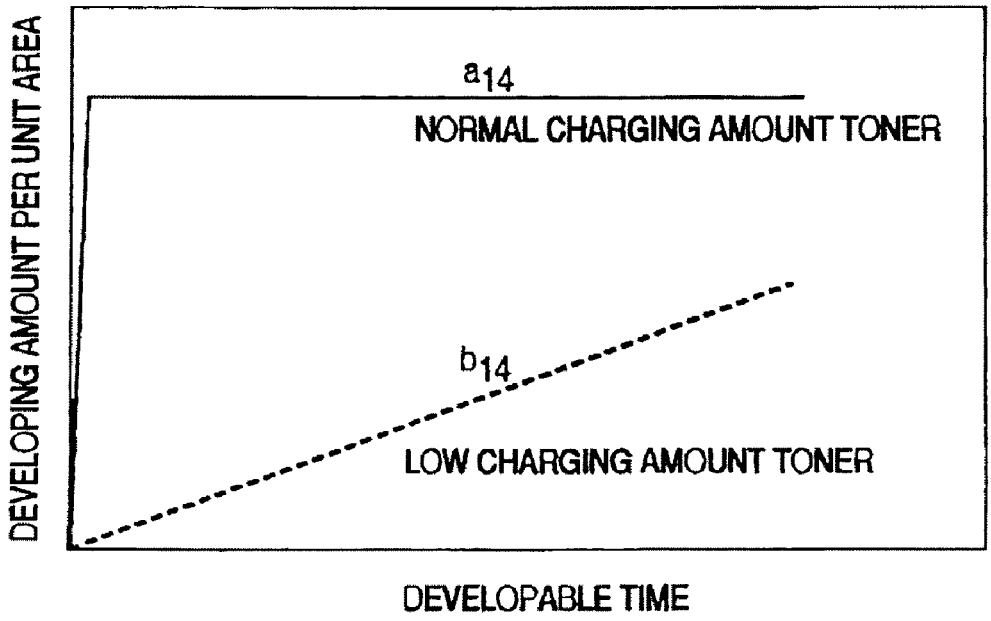
FIG. 14 is a graph comparing the developing amount per unit area of the photosensitive drum relative to a developable time between the case of a toner having a normal charging amount and the case of a toner having a low charging amount.
Figure 15:
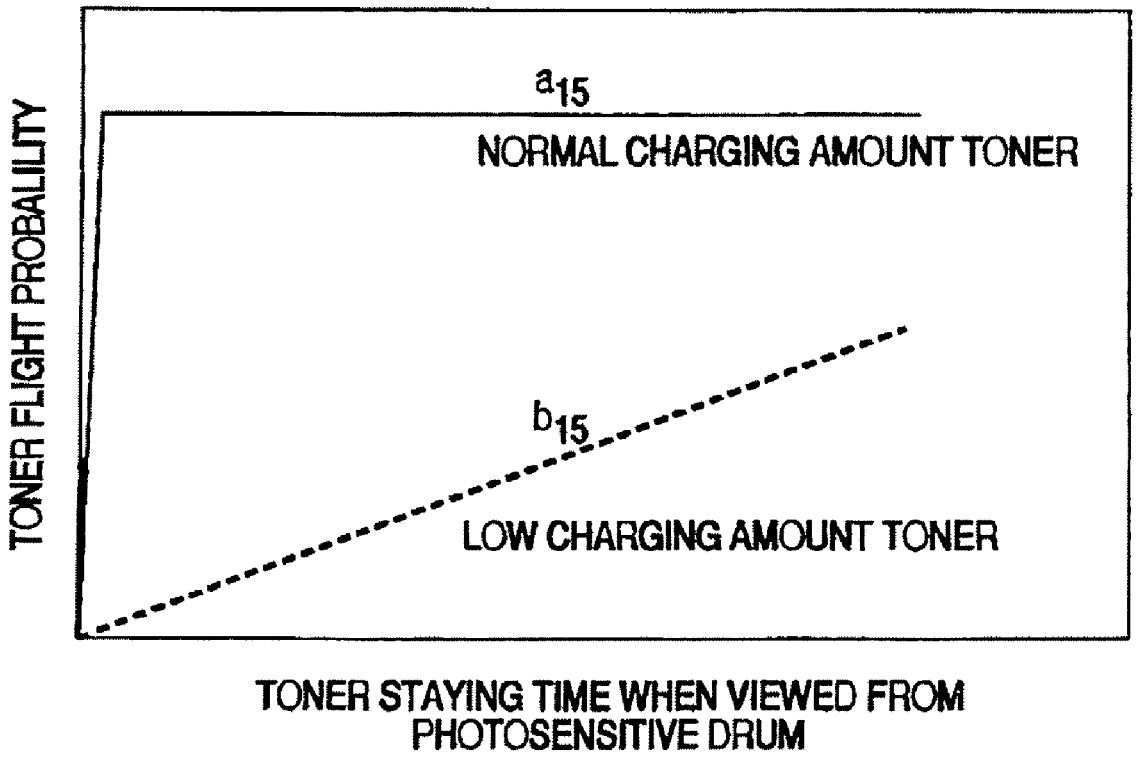
FIG. 15 is a graph comparing the toner flight probability relative to the toner staying time when viewed from the photosensitive drum between the case of the toner having a normal charging amount and the case of the toner having a low charging amount.

When at the OHT mode, etc., the peripheral speed of the photosensitive drum 1*a* is reduced by half, the developable time (the time required for the photosensitive drum 1*a* to pass the developing nip portion D) becomes double, as previously described Therefore, as indicated by dotted line "$b_{14}$" in FIG. 14, a low charging amount toner increases to nearly double that at the plain paper mode in the developing amount (fog amount) per unit area. Also, when at the same time, the peripheral speed of the developing sleeve is reduced by half, the toner staying time on the developing sleeve when viewed from the photosensitive drum also becomes double and therefore, as indicated by dotted line "$b_{15}$" in FIG. 15, the flight probability of the low charging amount toner increases correspondingly.

So, if the peripheral speed ratio between the photosensitive drum 1*a* and the developing sleeve 21 is controlled to 3.0 without the peripheral speed of the developing sleeve 21 being changed from that at the plain paper mode even when the peripheral speed of the photosensitive drum 1*a* is reduced by half, the toner staying time on the developing sleeve when viewed from the photosensitive drum becomes half the length of the time at the plain paper mode in calculation and therefore, the flight probability of the toner is also reduced by half. Thereby, the developing amount is increased by the peripheral speed of the photosensitive drum 1*a* being made low, but correspondingly, the flight probability of the toner can be made small by the peripheral speed ratio of the developing sleeve 21 to the photosensitive drum 1*a* being made double that at the plain paper mode. As the result, the reflectivity of the fog on the photosensitive drum can be suppressed to a level similar to that at the plain paper mode.

In the present embodiment, however, the peripheral speed ratio of the developing sleeve 21 to the photosensitive drum 1*a* is not a fixed value of 3.0, but is designed to be changed within the following range in accordance with an absolute amount of water calculated on the basis of a temperature and humidity detected by a temperature and humidity detecting sensor 40 as temperature and humidity detecting means which is an environment detecting sensor installed in the image forming apparatus, as shown in FIG. 2.

Figure 6:
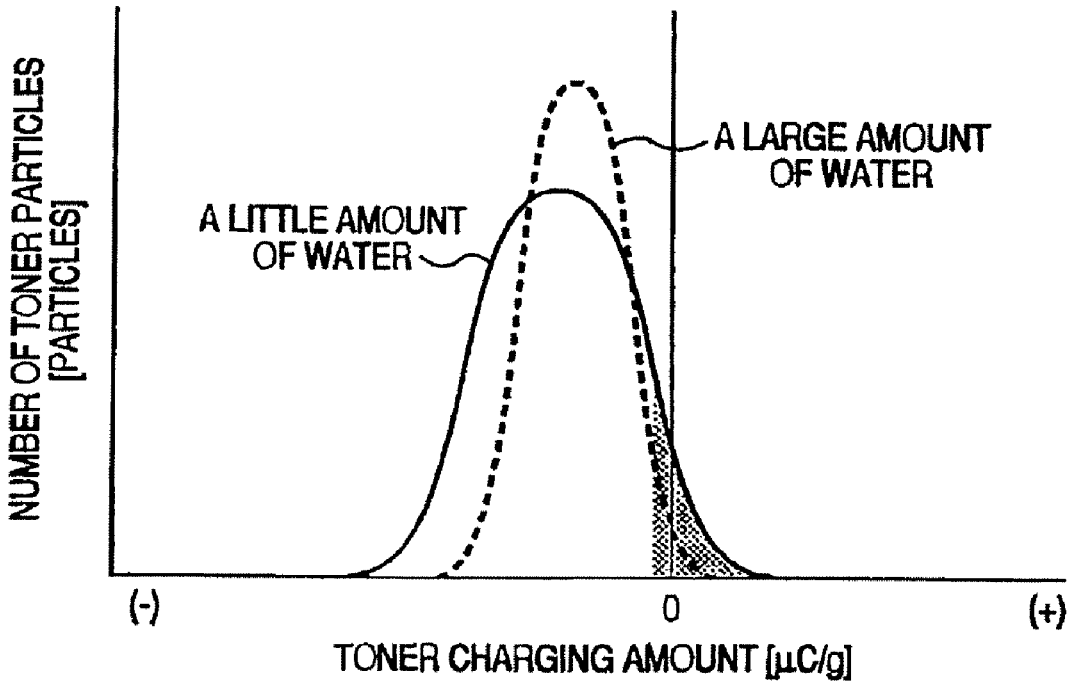
FIG. 6 shows the distributions of a toner charging amount when the amount of water is large and when the amount of water is a little.

It is known that the charging amount distribution of the developer is actually fluctuated by the environment under which the image forming apparatus is installed, as shown in FIG. 6. As shown in FIG. 6, in the case of an environment in which the absolute amount of water indicated by dotted line is large, the distribution of a low charging amount becomes narrow while on the other hand, in the case of an environment in which the absolute amount of water is little, the distribution of the low charging amount becomes wide. The flight probability of the toner having a low charging amount actually has a certain degree of range depending on the charging amount of the toner.

Figure 7:
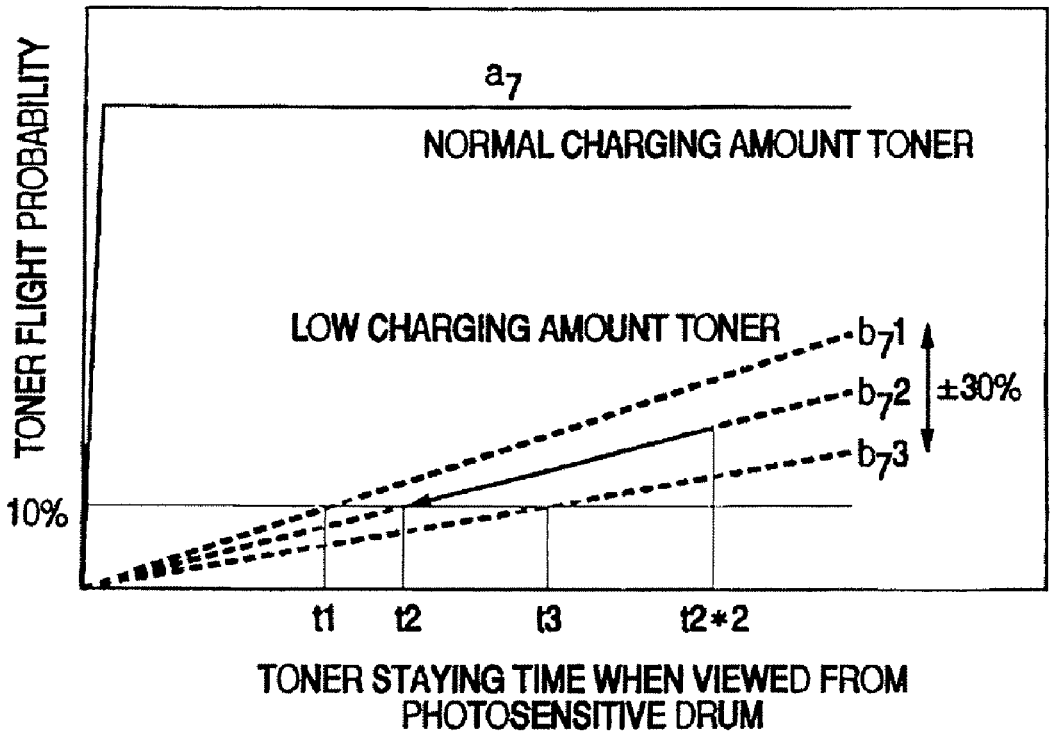
FIG. 7 illustrates the relation between the toner staying time when viewed from the photosensitive drum and the toner flight probability.

According to the inventors' study, it has become apparent that the inclination of the flight probability of the toner has a range of .±.30% with respect to the center, as shown in FIG. 7. The flight probability of the toner with which the fog is actualized relative to an image is nearly 10%, and if it is less than 10%, there is substantially no problem. It will be seen that in the case of a toner in which the inclination is "$b_7$3" in FIG. 7, a time of t3 or less is good. It will also be seen that in the case of a toner in which the inclination is "$b_7$2" in FIG. 7, a time of t2 or less is good. When the peripheral speed ratio of the developing sleeve 21 to the photosensitive drum 1*a* is made greater than that at the plain paper mode, the number of revolutions of the developing sleeve rotated per sheet of image during the image forming operation becomes greater than at the plain paper mode, and there arises the problem that the deterioration of the developer is progressed correspondingly quickly. Therefore, the above-described peripheral speed ratio should preferable be made small to the utmost.

So, for example, in a case where the distribution in which the toner is at the flight probability "$b_7$3" is large (an environment having a large amount of water), it is good to set the peripheral speed of the developing sleeve to −30% of that at the plain paper mode, that is, set the peripheral speed ratio to 2.1.

Also, in the case of a toner of which the flight probability assumes an inclination "$b_7$1" in FIG. 7, a desired fog level is not reached unless the time is t1 or less, and therefore, in a case where the distribution in which the toner is at the flight probability "$b_7$1" is large (an environment having a little amount of water), it is good to set the peripheral speed of the developing sleeve to +30% of that at the plain paper mode, that is, set the peripheral speed ratio to 3.9. By effecting such control, it is possible to decrease the deterioration of the developer to the utmost and yet, better the fog level in any environment of use.

The reflectivity of the fog on the photosensitive drum when the control of the present embodiment was effected is indicated by dot-and-dash line "$c_5$" in FIG. 5. It is shown that this reflectivity of the fog is substantially equal to the reflectivity of the fog at the plain paper mode indicated by solid line "$a_5$" in FIG. 5.

While in the present embodiment, the peripheral speed ratio Vr between the photosensitive drum 1*a* and the developing sleeve 21 at the plain paper mode is set to 1.5 , this value may be suitably changed by the construction of the developing apparatus, the developing bias and the kind of the developer.

As described above, even when the peripheral speed of the photosensitive drum becomes low at the OHT mode, etc. and the developable time increases, it becomes possible to make the peripheral speed ratio of the developing sleeve to the photosensitive drum greater by a predetermined amount than the peripheral speed ratio at the normal image forming mode to thereby maintain the fog of the white background portion at as high a level as that at the plain paper mode, and obtain an image of high quality always stably at any operating mode.

While in the foregoing, a case where the rotating speed of the photosensitive drum as the image bearing member is reduced by half has been described as an example, the present invention is not restricted thereto, but a second rotating speed of the photosensitive drum is controlled to less than 70% of a first rotating speed, and the rotating speed of the developing sleeve as the developer carrying member is controlled within a range of ±30% of the speed at a mode whereat image formation is effected at the first rotating speed of the photosensitive drum, whereby the peripheral speed ratio of the rotating speed of the developing sleeve to the rotating speed of the photosensitive drum can be made higher during the second rotation of the photosensitive drum than during the first rotation thereof and therefore, it is possible to suppress the fog of the white background portion to as high a level as that at the plain paper mode. That is, even when the rotating speed of the photosensitive drum is made less than 70%, if the rotating speed of the developing sleeve is kept within the range of ±30% the fog can be suppressed.

Embodiment 2

Embodiment 2 will now be described. The general constructions of an image forming apparatus and a developing apparatus according to this embodiment are similar to those of Embodiment 1 described above, but this embodiment is characterized in that at an image forming mode whereat the peripheral speed of the photosensitive drum becomes lower than that at a normal image forming mode, the peripheral speed ratio of the developing sleeve to the photosensitive drum is made variable in accordance with the period of use of the developer.

Figure 8:
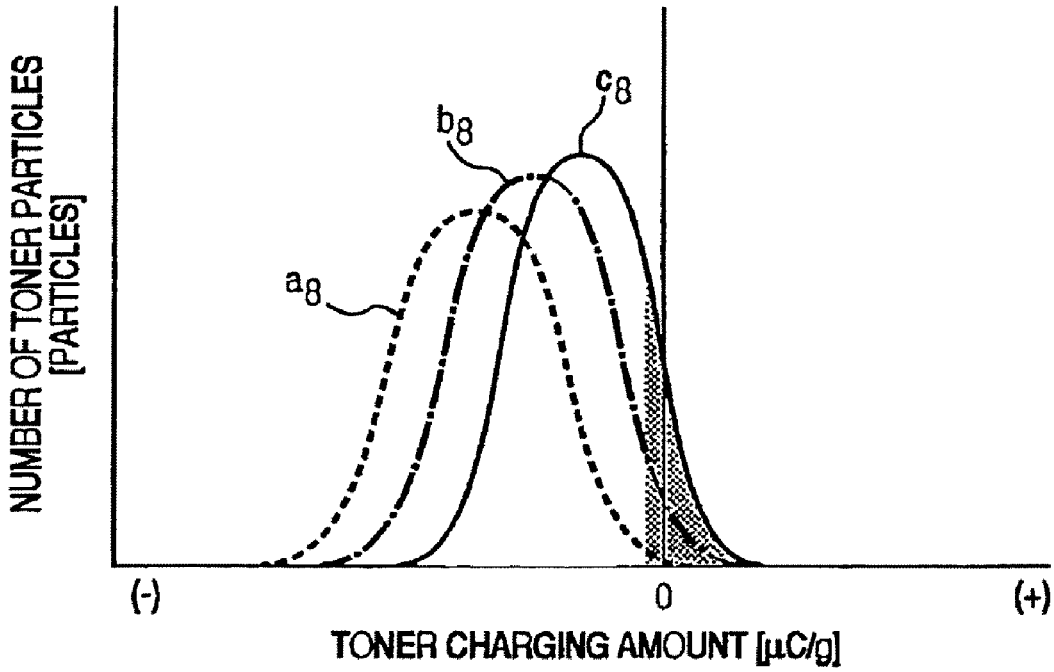
FIG. 8 illustrates the manner in which the distribution of the toner charging amount is changed by an increase in the period of use of a developer.

The charging amount distribution of the toner in the developing apparatus becomes such a distribution as indicated by solid line "$a_8$" in FIG. 8. The proportion of a toner of which the charging amount is in the vicinity of 0 (zero) or a toner charged to the opposite polarity is very low. However, when the period of use of the developer becomes long, the states of carrier particles and the developing sleeve on the side giving charges or the states of a charge control agent for the toner and an extraneous additive assisting charging are deteriorated as previously described and therefore, it becomes impossible to give a desired charging amount to a supplied toner, and the charging amount distribution of the toner in the developing apparatus gradually changes from the distribution of solid line "$a_8$" in FIG. 8 to a distribution indicated by dot-and-dash line "$b_8$", and further to a distribution indicated by dotted line. That is, the proportion of a toner having a low charging amount heightens with an increase in the period of use of the developer.

In a state in which the proportion of the toner having a low charging amount has heightened in the developing apparatus, fog becomes liable to occur at an image forming mode such as the OHT mode whereat the peripheral speed of the photosensitive drum is made low, as previously described, and therefore, in that case, as described in Embodiment 1, means for making the peripheral speed ratio of the developing sleeve to the photosensitive drum greater than at the plain paper mode is effective.

However, when the peripheral speed ratio of the developing sleeve to the photosensitive drum is made greater than at the plain paper mode, the number of revolutions of the developing sleeve rotated per sheet of image during the image forming operation becomes greater than at the plain paper mode and therefore, there arises the problem that the deterioration of the developer is progressed correspondingly quickly.

So, in the present embodiment, the peripheral speed of the developing sleeve at the image forming mode whereat the peripheral speed of the photosensitive drum is made low, i.e., the peripheral speed ratio of the developing sleeve to the photosensitive drum, is controlled in accordance with the length of the period of use of the developer to thereby solve this problem.

The image forming apparatus according to the present embodiment has counting means (not shown) for counting the number of image-formed sheets after the use of the developer has been started, and memory means (not shown) for storing the integrated value of the number of image-formed sheets therein, and the peripheral speed ratio of the developing sleeve to the photosensitive drum is controlled on the basis of the integrated value of the number of image-formed sheets stored in this memory means. While in the present embodiment, control is effected by the use of the integrated value of the number of image-formed sheets substantially proportional to the integrated value of the number of revolutions of the developing sleeve, means for counting the number of revolutions or the rotation time of the developing sleeve may be provided so that control may be effected on the basis of the integrated value thereof.

Also, the present embodiment has, besides the plain paper mode, the OHT mode and the thick paper mode as in Embodiment 1, and the peripheral speed of the photosensitive drum at the plain paper mode is set to 160 mm/sec., and the peripheral speed thereof at the OHT mode is set to 80 mm/sec., and at the initial stage of the use of the developer, at both of the these modes, the peripheral speed ratio of the developing sleeve to the photosensitive drum is set to 1.5.

At the initial stage of the use of the developer, the proportion of the low charging amount in the charging amount distribution of the toner is very small and therefore, there is brought about a state in which it is difficult for fog to occur, and when the peripheral speed of the photosensitive drum is made low at the OHT mode, etc., the peripheral speed of the developing sleeve is also decelerated at the same deceleration rate, and even if the peripheral speed ratio is not changed, the fog level is not aggravated. Also, at this time, the peripheral speed ratio of the developing sleeve to the photosensitive drum is made the same as that at the plain paper mode, whereby the deterioration of the developer due to an increase in the number of revolutions of the developing sleeve can be suppressed.

When the period of use of the developer has become long and the integrated value of the number of image-formed sheets stored in the memory means has become 20,000 sheets or more, the peripheral speed of the developing sleeve at the OHT mode, etc. is changed from initially set 120 mm/sec. to 240 mm/sec. which is the same as the peripheral speed at the plain paper mode. The peripheral speed ratio of the developing sleeve to the photosensitive drum at this time is 3.0, which is 2.0 times as great as the peripheral speed ratio at the plain paper mode. By effecting such control, it is possible to suppress the fog of the white background portion due to the toner having a charging amount in the vicinity of 0 (zero) increased with an increase in the period of use of the developer, or the toner charged to the opposite polarity, at the OHT mode, etc. as well as at the plain paper mode.

Further, when the integrated value of the number of image-formed sheets has become 40,000 sheets or more, the peripheral speed of the developing sleeve at the OHT mode, etc. is increased to 280 mm/sec. The peripheral speed ratio of the developing sleeve to the photosensitive drum at this time is 3.5, which is 2.3 times as great as the peripheral speed ratio at the plain paper mode. By effecting such control, it is possible to suppress the fog of the white background portion at the OHT mode, etc. as well as at the plain paper mode even if there is brought about a state in which the deterioration of the developer has further progressed and the distribution of the toner having a charging amount in the vicinity of 0 (zero) or the toner charged to the opposite polarity has considerably increased. The summary of what has been described above is shown in FIG. 9.

As described above, at an image forming mode such as the OHT mode whereat the peripheral speed of the photosensitive drum becomes low, control is effected so as to make the peripheral speed ratio of the developing sleeve to the photosensitive drum greater by a predetermined amount than the peripheral speed ratio at the normal image forming mode, in accordance with the period of use of the developer, whereby it becomes possible to prevent the wasteful deterioration of the developer at the initial stage of the use of the developer and yet, maintain the level of fog at the late stage of the use of the developer at a level equal to that at the plain paper mode, and it is possible to obtain images of high quality stably for a long period of use at any image forming mode.

Embodiment 3

Embodiment 3 will now be described. The general construction of an image forming apparatus according to this embodiment is similar to that of Embodiments 1 and 2, but the present embodiment is characterized in that at an image forming mode such as the OHT mode whereat the peripheral speed of the photosensitive drum is made lower than at the normal image forming mode, the ratio of the peripheral speed of the agitating means to the peripheral speed of the developing sleeve is changed.

In the developing apparatus of an image forming apparatus, the developing sleeve and the agitating means are generally connected to the driving gear of an image forming apparatus main body through one and the same gear train, and the peripheral speed ratio between the two is fixed and therefore, when the peripheral speed of the developing sleeve is made high, the peripheral speed of the agitating means also becomes high. If in such a construction, as in Embodiments 1 and 2, at the image forming mode such as the OHT mode whereat the peripheral speed of the photosensitive drum is made low, the peripheral speed of the developing sleeve is made higher within the range of +30% than at the plain paper mode, the peripheral speed of the agitating means also becomes higher at the same time, and the speed at which the dual-component developer circulates in the developing apparatus becomes high. When the circulating speed of the dual-component developer becomes high, the frequency with which carrier particles and toner particles contact with and rub against each other per unit time increases and therefore, the deterioration of the developer is correspondingly quickened.

Figures 9, 10:
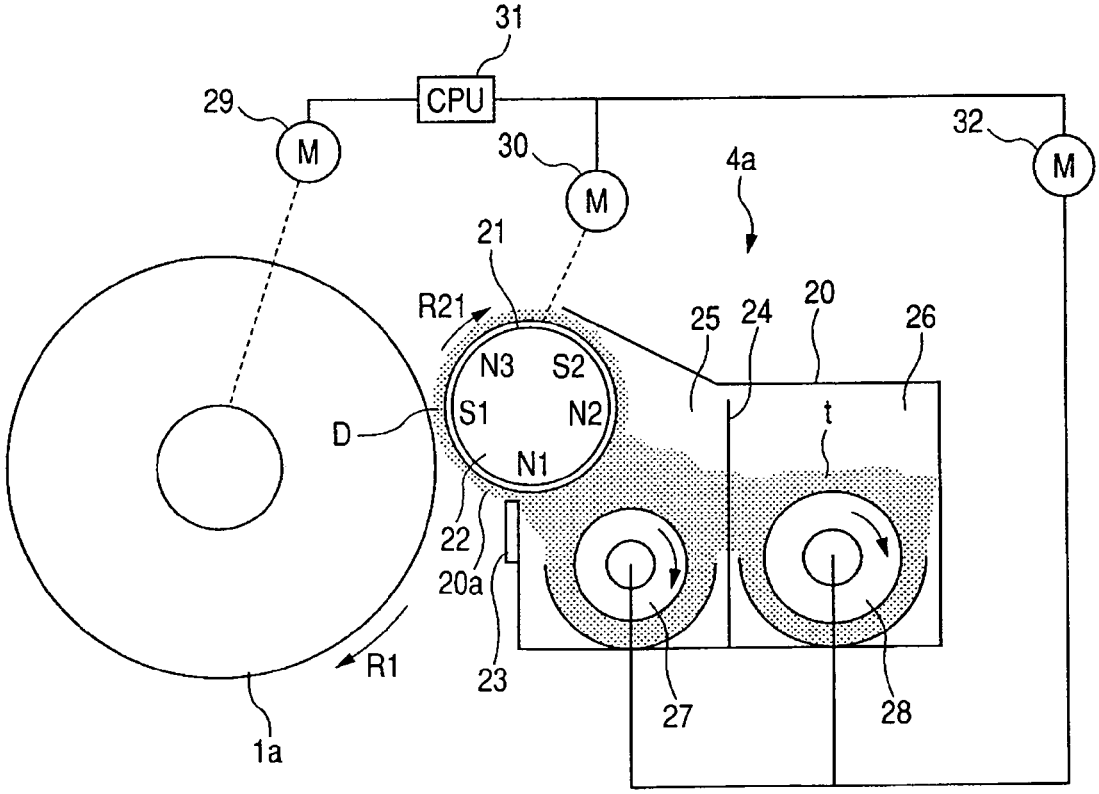
FIG. 9 illustrates the relation between the integrated value of the number of image-formed sheets and the peripheral speed ratios at the plain paper mode and at the OHT, thick paper mode.
FIG. 10 is an enlarged longitudinal cross-sectional view typically showing the construction of a developing apparatus in Embodiment 3.
Figure 13:
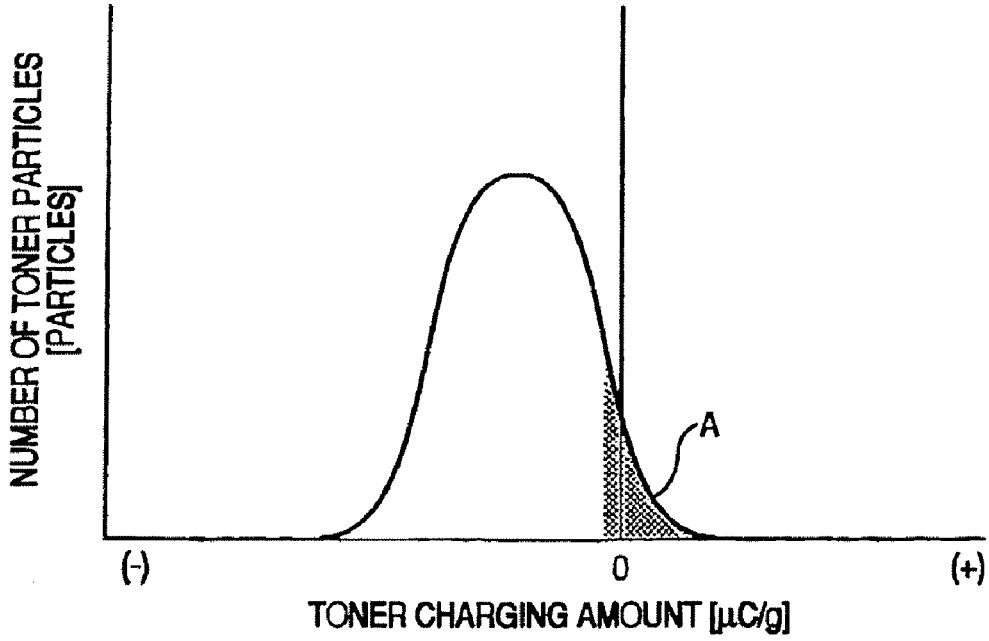
FIG. 13 illustrates the distribution of the toner changing amount in the developing apparatus when fog is liable to occur.

So, the construction of the developing apparatus according to the present embodiment, as shown in FIG. 10, is a construction in which the photosensitive drum 1*a*, the developing sleeve 21 and the conveying screws 27 and 28 as the agitating means are driven by discrete independent motors 29, 30 and 32, respectively, and the peripheral speeds thereof can be changed by a CPU 31. In the construction of FIG. 10, members similar to those in FIG. 2 are given the same reference characters and need not be described.

The substance of control in the present embodiment is shown in FIG. 11.

As in Embodiment 1, when the peripheral speed of the photosensitive drum at the OHT mode, etc. has been reduced by half to 80 mm/sec., the peripheral speed of the developing sleeve is controlled within the range of ±30% of that at the plain paper mode, i.e., 168 mm/sec. or greater and 312 mm/sec. or less, in order to suppress the fog, but the peripheral speed of the agitating means is reduced by half like that of the photosensitive drum, and is controlled to 204 mm/sec. By effecting such control, it is possible to more reduce the deterioration of the developer at the OHT mode, etc. than in the case of Embodiment 2.

As described above, the peripheral speeds of the agitating means for the developer and the developing sleeve are controlled independently of each by the discrete motors, whereby at the image forming mode such as the OHT mode whereat the peripheral speed of the photosensitive drum becomes low, the peripheral speed of the agitating means can be made low while the peripheral speed of the developing sleeve is kept high and therefore, it becomes possible to suppress the occurrence of the fog and yet, also suppress the progress of the deterioration of the developer, and it is possible to obtain images of high quality more stably at any image forming mode.

This application claims priority from Japanese Patent Application No. 2004-362070 filed on Dec. 14, 2004, which is hereby incorporated by reference herein.

What is claimed is:

1. An image forming apparatus comprising:

an image bearing member rotatable with an electrostatic image borne thereon;

a developer carrying member rotated with a developer carried thereon and conveying the developer to a developing portion to develop of the electrostatic image;

image bearing member speed controlling means for switching a rotating speed of said image bearing member between a first speed and a second speed lower than the first speed, and performing an image forming operation at each speed; and developer carrying member speed controlling means for controlling a rotating speed of said developer carrying member so that a rotating speed of said developer carrying member when the image forming operation is performed by rotating said image bearing member at the second speed, which is less than 70% of the first speed so as to be within a range of ±30% of a rotating speed of said developer carrying member when the image forming operation is performed by rotating said image bearing member at the first speed.

2. An image forming apparatus according to claim 1, further comprising:

temperature and humidity detecting means for detecting temperature and humidity, wherein said developer carrying member speed controlling means changes the rotating speed of said developer carrying member when the image forming operation is performed at the second speed, in accordance with a result of detection by said temperature and humidity detecting means.

3. An image forming apparatus according to claim 1, further comprising:

counting means for counting a number of revolutions or a rotation time of said developer carrying member; and memory means for storing an integrated value of the number of revolutions or the rotation time of said developer carrying member counted by said counting means, wherein said developer carrying member speed controlling means changes the rotating speed of said developer carrying member when the image forming operation is performed at the second speed, in accordance with the integrated value of the number of revolutions or the rotation time of said developer carrying member stored in said memory means.

4. An image forming apparatus according to claim 1, further comprising:

rotatable agitating means for conveying the developer to said developer carrying member while agitating the developer, wherein the developer has carrier particles and toner particles, and a ratio between a rotating speed of said agitating means and the rotating speed of said developer carrying member when the image forming operation is performed at the second speed differs from a ratio between the rotating speed of said agitating means and the rotating speed of said developer carrying member when the image forming operation is performed at the first speed.

* * * * *

UNITED STATES PATENT AND TRADEMARK OFFICE

CERTIFICATE OF CORRECTION

PATENT NO. : 7,317,889 B2
APPLICATION NO. : 11/290501
DATED : January 8, 2008
INVENTOR(S) : Hideaki Suzuki It is certified that error appears in the above-identified patent and that said Letters Patent is hereby corrected as shown below:

COLUMN 4:
Line 34, “made” should read --made low.--.

COLUMN 6:
Line 38, “after” should read --after being--.

COLUMN 8:
Line 38, “.± - .30%” should read --± - 30%--.

COLUMN 9:
Line 27, “described” should read --described.--.

COLUMN 10:
Line 11, “.± - .30%” should read --± - 30%--.

COLUMN 12:
Line 33, “the these” should read --these--.

COLUMN 14:
Line 40, “develop of” should read --develop--.

Signed and Sealed this

Fifth Day of August, 2008

JON W. DUDAS
*Director of the United States Patent and Trademark Office*